US005357701A

United States Patent [19]

Grate

[11] Patent Number: 5,357,701

[45] Date of Patent: Oct. 25, 1994

[54] REPLACEABLE FIGURE PANELS FOR AN ATTRACTION BOARD

[76] Inventor: Anton Grate, 405 Westridge, Joliet, Ill. 60435

[21] Appl. No.: 102,811

[22] Filed: Aug. 6, 1993

[51] Int. Cl.[5] ..... G09F 7/02

[52] U.S. Cl. ..... 40/618; 40/620

[58] Field of Search ..... 40/5, 620, 618, 621, 40/622

[56] References Cited

U.S. PATENT DOCUMENTS

| | | | |
|---|---|---|---|
| 1,524,668 | 2/1925 | Miller . | |
| 1,779,190 | 10/1930 | Send | 40/618 |
| 1,887,591 | 11/1932 | Fugita | 40/618 |
| 2,038,978 | 4/1936 | Adler . | |
| 2,058,168 | 10/1936 | Merk . | |
| 2,113,285 | 4/1938 | Wamser . | |
| 2,313,723 | 3/1943 | Adler | 40/618 |
| 2,313,724 | 3/1943 | Adler . | |
| 2,630,643 | 3/1953 | Smithson et al. | 40/618 |
| 2,817,914 | 12/1957 | Rosen | 40/620 |
| 3,142,124 | 7/1964 | Ownby . | |
| 3,742,633 | 7/1973 | Palm . | |
| 3,883,967 | 5/1975 | Barnes . | |
| 4,367,604 | 1/1983 | Porter, II et al. | 40/618 |
| 4,693,026 | 9/1987 | Callahan . | |
| 5,065,537 | 11/1991 | Bailey . | |
| 5,257,472 | 11/1993 | Harnois et al. | 40/618 |

FOREIGN PATENT DOCUMENTS

| | | | |
|---|---|---|---|
| 755402 | 11/1954 | Canada | 40/618 |

*Primary Examiner*—James R. Brittain
*Assistant Examiner*—Cassandra Davis
*Attorney, Agent, or Firm*—Patnaude, Videbeck & Marsh

[57] ABSTRACT

An enlarged figure panel for attachment to an attraction board has a planar panel which is adapted to fit over the outer surfaces of the rails defining the channels of the attraction board. A plurality of offset flanges which extend parallel to the surface of the panel are adapted to fit under the upper and lower lips of the tracks of at least one channel of the attraction board for attaching the figure board thereto. A U-shaped spring or a tab is also provided to prevent the figure panel from being blown out of a track of an attraction board by wind.

8 Claims, 3 Drawing Sheets

REPLACEABLE FIGURE PANELS FOR AN ATTRACTION BOARD

The present invention relates to figure panels which bear letters or numbers or figures for attraction boards and in particular to over-sized panels which bear enlarged numbers or letters and which may have retaining springs or lips to prevent the figure panel from being blown off an attraction board by high winds.

BACKGROUND OF THE INVENTION

Various types of attraction boards are available and among the more common are those having a plurality of parallel tracks having rails with lips overlapping the upper and lower ends and into which can be fitted a plurality of panels, each of which has a letter or number printed thereon. The panels can be arranged on the attraction board to spell out words or show numerals, such as prices or the like. In some cases, the attraction board is fitted with an internal light and the figure panels are partially transparent such that the board and text formed by the assembled figure panels is visible after sunset, and presents a bright appearance during daylight hours.

To change the figure panels of an attraction board having a plurality of tracks, it is customary to use a tool having a suction cup and an extended arm. The suction cup is attached to a figure panel and raised to the desired track with the upper edge of the figure panel abutting the upper inner edge of the track. Thereafter, the lower edge of the figure panel can be moved across the upwardly extending lower edge of the track, and the suction cup released. The figure panel will then be retained under an upwardly extending lower lip and a downwardly extending upper lip of the track.

It is frequently desirable, however, to display enlarged figures on an attraction board. For example, it is desirable to display sale prices in enlarged numerals. Prior to the present invention, however, no adequate solution has been available for providing enlarged figures on an attraction board having a plurality of tracks. Enlarged figures have been attached to such attraction boards by printing the figures on panels which have a length which spans two or more tracks. The upper end of such figure panels is fitted under the downwardly extending lip of an upper track and the lower end of the panel fitted under the upwardly extending lip of a lower track and the midsection of the figure panels are arched or bowed over the rails which are spanned by the enlarged figure panel. Such prior art figure panels cannot be installed by the use of the elongate tool having a suction cup at one end thereof as previously described, but require instead that an installer climb a ladder and manually bend the enlarged figure panel, and fit the upper and lower ends between the lips of the appropriate tracks of the attraction board.

Attraction boards which consist of a plurality of parallel tracks are also subject to having the figure panels positioned therein blown out during high winds. It would, therefore, be desirable to provide a figure panel for a track mounting attraction board which has a visible surface with a height higher than the height of the tracks of the attraction board. It would also be desirable to provide a means for retaining figure panels to a track type attraction board such that the figure panel will not be dislodged during high winds.

SUMMARY OF THE INVENTION

Briefly, the present invention is embodied in a figure panel for an attraction board having a plurality of parallel, equally spaced horizontal tracks where each track has an upper inner edge and a parallel lower inner edge. Each track of such an attraction board also has a downwardly extending upper lip and an upwardly extending lower lip, and the downwardly extending upper lip extends a greater distance downwardly than the upwardly extending lower lip extends upwardly.

A figure panel in accordance with the present invention has a planar panel with an inner surface to which are attached first and second opposing flanges. The first and second opposing flanges extend in opposite directions from each other parallel to the inner surface of the panel and are spaced such that the first flange can be fitted under the upper downwardly extending upper lip of a track and the second flange can be fitted under the upwardly extending lower lip of the same track.

In another embodiment of the invention, the first and second flanges are spaced such that the first flange can be fitted under the upper lip of a first track and the lower flange can be fitted under the upwardly extending lower lip of a second track. In another embodiment of the invention, a third flange is positioned between the first and second flanges and extends parallel to the inner surface of the panel, and is positioned so as to fit under an intermediate lip and thereby retain the panel to the attraction board.

Another feature of the present invention is a U-shaped spring at the upper edge of the figure panel for compressing the figure panel downwardly against the lower inner edge of the track. When a spring in accordance with the present invention is fitted to a figure panel for displaying an enlarged figure as described above, the U-shaped spring is attached to the upper edge of the upwardly extending first flange.

Another embodiment provides a means for retaining a figure panel in a track so as to prevent blow out thereof by including a tab extending upwardly from one side thereof. The length of the figure panel at the end having the tab is such that the panel cannot be worked out of a track once the tab is fitted into the track. A figure panel having a tab at the upper end thereof can be installed with a conventional elongate tool with a suction cup at the end thereof. The tool is used to install the figure panel to the attraction board with the portion of the figure panel bearing the tab positioned outwardly of the lips of the upper rail. After the figure panel is installed in the track, it can be slid to the desired position along the track and the tab will be slid under a downwardly extending upper lip and the height of the figure panel, including the tab will then prevent blow out of the panel.

GENERAL DESCRIPTION OF THE DRAWINGS

Further objects and advantages and a better understanding of the present invention will be had by reference to the following detailed description taken in conjunction with the accompanying drawings wherein.

DETAILED DESCRIPTION OF PREFERRED EMBODIMENTS OF THE INVENTION

Figure 2:
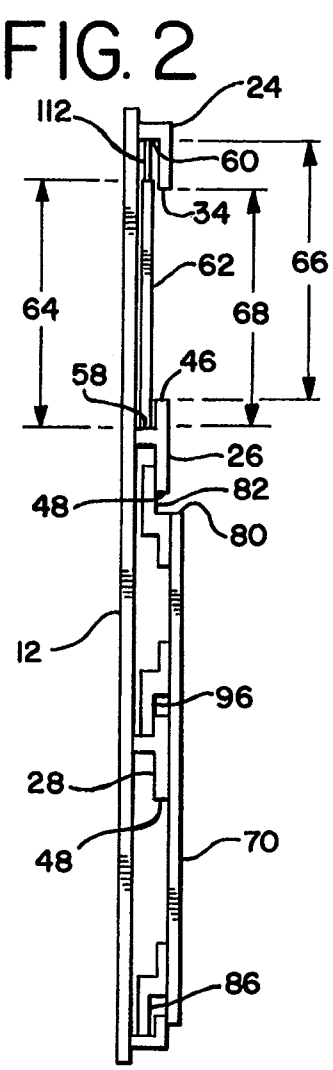
FIG. 2 is a side view of the attraction board shown in FIG. 1 and of two of the embodiments of a figure panel shown in FIG. 1.
Figure 1:
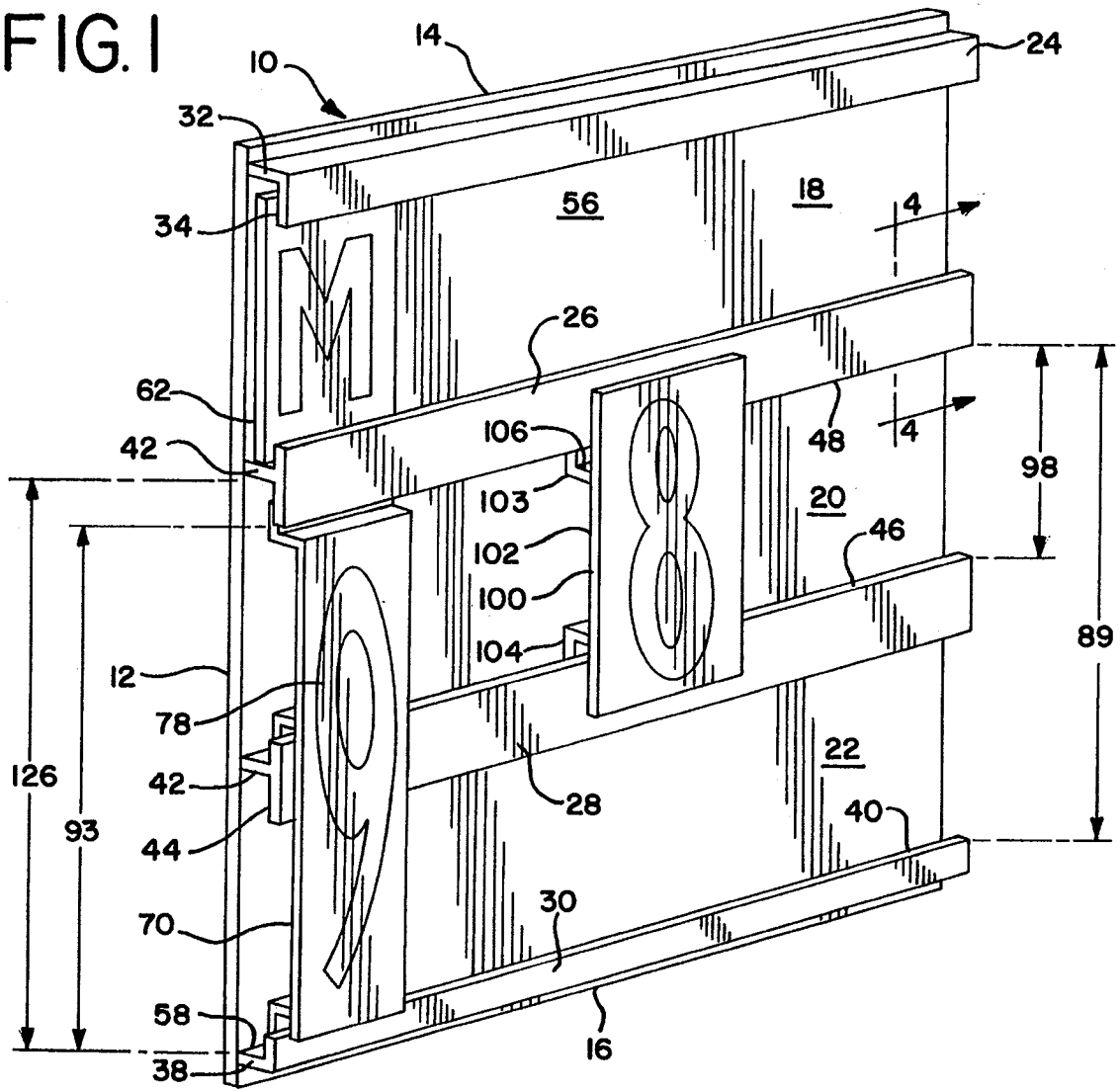
FIG. 1 is an isometric view of an attraction board having a plurality of figure panels mounted thereon which embody the present invention.
Figure 4:
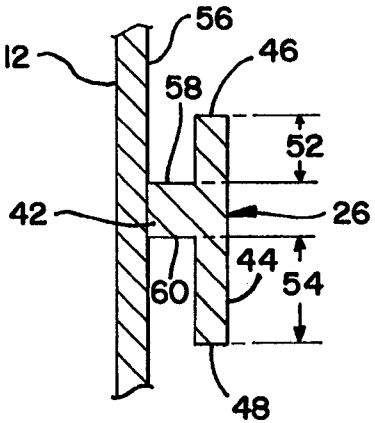
FIG. 4 is a fragmentary cross sectional view of the rail which is part of the attraction board shown in FIG. 1 taken through lines 4—4 of FIG. 1.

Referring to FIGS. 1, 2 and 4, an attraction board 10 has a generally rigid rectangular planar back 12 having an upper edge 14 and a lower edge 16 across which there are a plurality of horizontal tracks 18, 20, 22.

The tracks 18, 20, 22 are formed by a plurality of rails 24, 26, 28, 30 which are parallel to each other and to the upper and lower edges 14, 16, respectively. As can be seen in FIG. 1, the upper rail 24 has a support leg 32 and a downwardly extending upper lip 34. Similarly, the bottom rail 30 has a support leg 38 and an upwardly extending lower lip 40. Each of the remaining rails 26, 28, which are positioned through the midsection of the attraction board 10 has a support leg 42 and a retaining panel 44 attached perpendicularly to the support leg 42 which form an upwardly extending lower lip 46 and a downwardly extending upper lip 48. As can be seen, the upwardly extending lower lip 46 of the midrails 26, 28 and the upwardly extending lower lip 40 of the lower rail 38 extend upwardly an equal distance 52 as shown in FIG. 4. Similarly, the downwardly extending upper lip 34 of the upper rail 24, and the downwardly extending upper lips 48 of the midrails 26, 28 all extend downwardly an equal distance 54. The distance 54 of the downward extension of the upper lips 34, 48 is typically at least twice the distance of the upwardly extending lower lip 40, 46.

The support legs 32, 38, 42 of the various rails retain the associated upper and lower lips a fixed distance from the outer surface 56 of the back 12, and each of the support legs 32, 38, 42 has under the associated lip, an upper inner surface 58, and a lower inner surface 60. As a result, each of the tracks 18, 20, 22 has an associated downwardly extending upper lip 34, 48, an upwardly extending lower lip 40, 46, an upper inner surface 58, and a lower inner surface 60. Typically, the support legs 32, 38, 42 are all of equal width and are positioned equal distance from one another.

A figure panel such as figure panel 62 for use with the attraction board 10 typically has an overall height 64 which is greater than the distance 68 between the lower inner surface 58 and the lower end of the downwardly extending upper lip 34, 48. The height 64 of the figure panel 62 is also less than the distance 66 between upper inner surface 60 and the upper edge of the upwardly extending lower lip 46. As a result, the figure panel 62 can be inserted into track 18 as shown in FIG. 1 by first positioning the upper end of the figure panel 62 under the upper lip 34 until the upper edge of the figure panel 62 abuts against the upper inner surface 60. Thereafter, the lower end of the figure panel 62 can be moved over the upwardly extending lower lip 46, and the panel can then be released so as to rest on the lower inner surface 58, where it will be retained between the upper and lower lips 34, 46, respectively.

Typically, attraction boards 10 are made with all of the tracks 18, 20, 22 of equal height, that is, the distances between the lower inner surface 58 and the upper inner surface 60 of all of the tracks are equal. On some occasions, attraction boards are made with a greater distance between the upper inner surface and the lower inner surface of the uppermost track such that larger figures can be put into the upper track than on the lower tracks. The attraction board 10 as depicted in FIG. 1, however, has tracks 18, 20, 22 all of which have equal heights.

Figure 5:
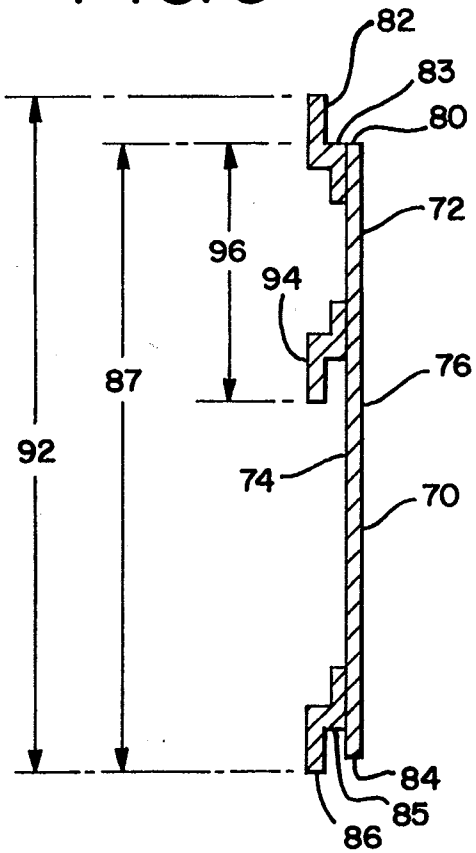
FIG. 5 is a side view of the figure panel shown in FIG. 3.
Figure 3:
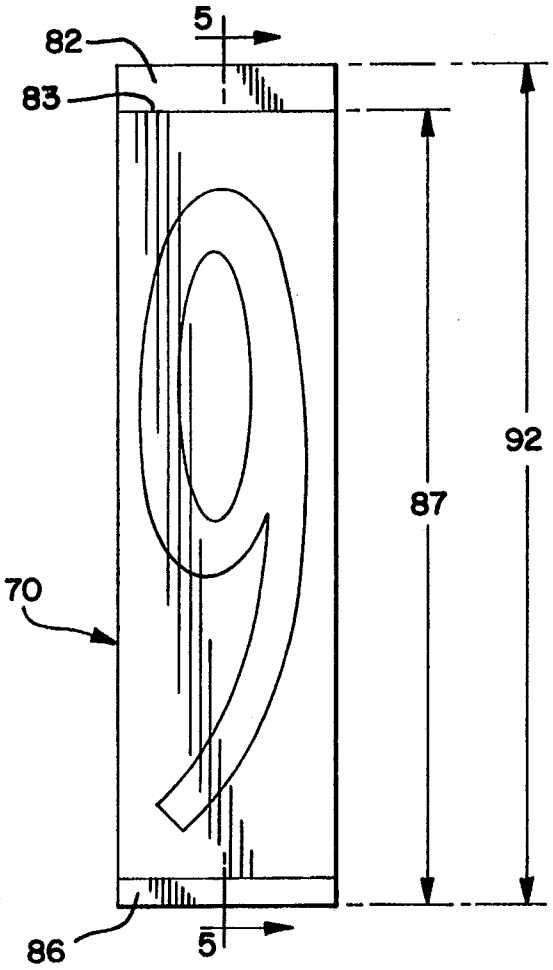
FIG. 3 is a front elevational view of one of the figure panels shown in FIG. 1 embodying the present invention.

A figure panel 70 adapted to display an enlarged figure and span two tracks is best shown in FIGS. 2, 3 and 5. The figure panel 70 has a rectangularly shaped planar body 72 which has a central portion 73, an inner surface 74 and an outer surface 76 upon which is imprinted a symbol 78 which can be seen by one viewing the attraction board 10. Attached to the inner surface 74 and adjacent the upper edge 80 of the body 72 is a planar first flange 82 which is offset relative to the inner surface 74 of the body 72 and extends outward of the central portion 73 and parallel to the inner surface 74. The offset forms an upper shoulder 83 which will enable the flange 82 to fit under a downwardly extending upper lip 48 of a rail while permitting the inner surface 74 of the body 72 to fit across the outer surfaces of the rails spanned by the enlarged figure panel 70. Similarly, there is attached along the inner surface 74, and parallel and adjacent to the lower edge 84 of the body 72, a second planar flange 86 which is also offset from the inner surface 74 a distance so as to fit under an upwardly extending lip and extends outward of the central portion 73 and parallel to the inner surface 74. The offset of the second flange 86 is such that it will enable the flange 86 to fit under an upwardly extending lip 40, 46 when the inner surface 74 of the body 72 is positioned to extend across the outer surfaces of the retaining panels 44 of the spanned rail 28 as best shown in FIGS. 1 and 2. Also, flange 86 is sufficiently long such that the offset shoulder 85 will not rest on the upper edge of the upwardly extending lip 40.

Referring to FIGS. 1, 3 and 5, to be attachable to two rails of the attraction board, the figure panel 70 has a height, that is the distance 87 between the upper shoulder 83 and the lower distal end of the second flange 86, which is less than the distance 89 between the lower edge of the downwardly extending upper lip 48 and the upper edge of the upwardly extending lower lip 40. As a result, when the first flange 82 is fitted under the upper lip 48 the second flange 86 can be moved across the upper lip 40. Also, the distance 92 between the distal ends of the first and second flanges 82, 86 is greater than the distance 93 between the lower inner surface 58 of track 22 and the lower edge of the downwardly extending lip 48 of track 20 such that the first and second flanges 82, 86 will be retained under the associated lips 48, 40, respectively, when the lower end of the lower flange 86 rest on the lower inner surface 58.

To further retain the figure panel 70 against the attraction board 10, a third flange 94 is positioned parallel to the upper and lower edges 80, 84 of the body 72 and is offset from the inner surface 74 a distance equal to the offset of the first and second flanges 82, 86. The third flange 94 is also planar, parallel to the inner surface 73, and it extends in a direction opposite to the direction of the first flange 82, as shown in FIG. 5. The third flange 94 is positioned such that the distance 96 between the shoulder 83 of the first flange 82 and the lower edge of the third flange 94 is less than the distance 98 between the distal ends of the upwardly extending lower lip 46 and the downwardly extending upper lip 48.

The figure panel 70 in accordance with the present invention can then be attached to a figure panel with an elongate tool having a suction cup at the distal end thereof such as is known in the art. First the upper flange 82 is positioned under a downwardly extending upper lip 48 with the upper shoulder 83 abutting the distal end of the lip 48, and thereafter the second and third flanges are moved across the associated upwardly extending lower lips 40, 46, respectively. Thereafter, the figure panel 70 can be lowered such that it rests upon the lower ends of the second and third flanges 86, 94 and is retained under the associated lips by the various flanges.

Referring to FIG. 1, a second embodiment of a figure panel 100 is also shown. In this embodiment, the figure panel 100 has a planar body 102 and offset upper and lower flanges 103, 104, respectively. The distances between the shoulder 106 of the upper flange 103 and the lower edge of the lower flange 104 is less than the distance 98, described above such that the flanges 103, 104 can be fitted within the tracks as previously described. Also, the upper flange 103 extends upwardly a distance which enables the flange to be retained under an upper lip of a track when the lower flange 104 is positioned on the lower inner surface of a lower lip.

Figure 7:
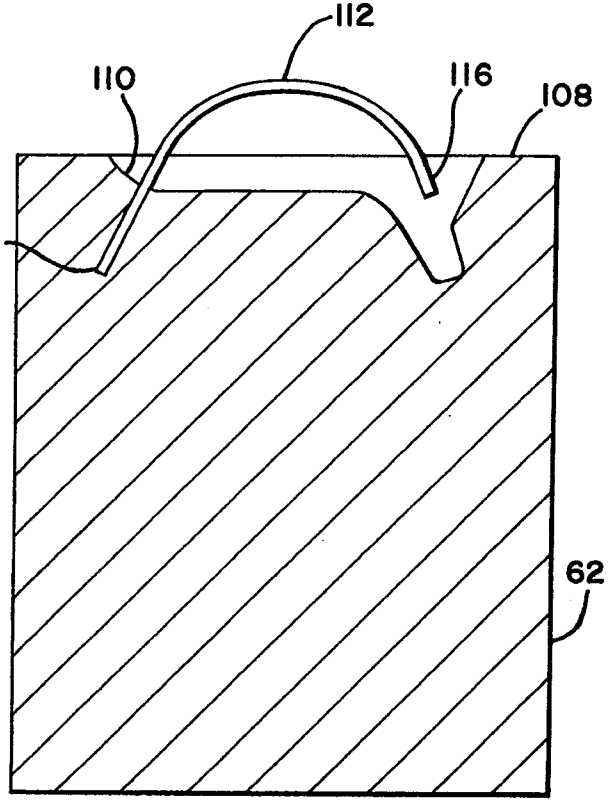
FIG. 7 is a cross-sectional view of the figure panel shown in FIG. 6 taken through line 7—7.
Figure 6:
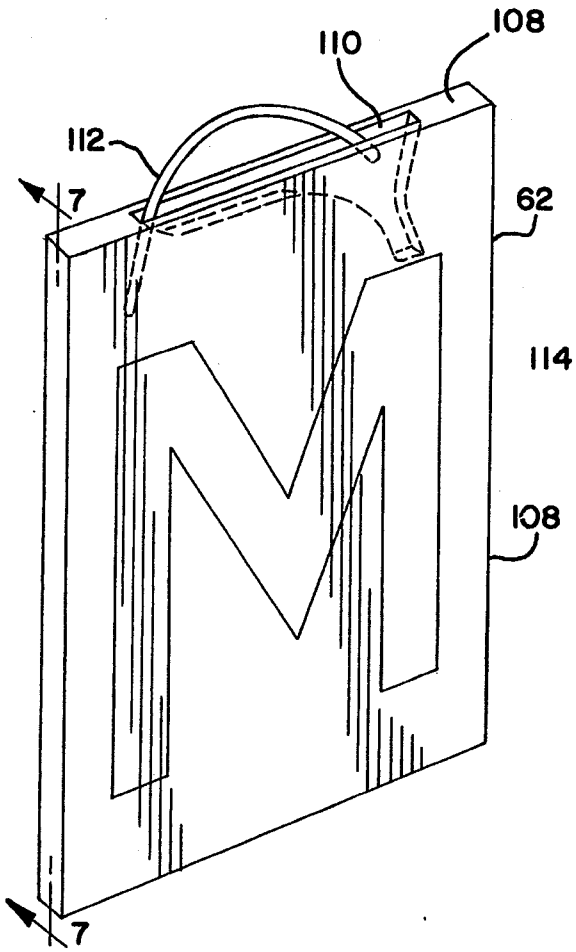
FIG. 6 is an enlarged isometric view of another of the figure panels shown in FIG. 1 with portions thereof shown in phantom lines.

Referring to FIGS. 6 and 7, figure panel 62 which has been previously described has an upper surface 108 into which has been cut a slot 110. A U-shaped spring 112 has one end 114 thereof attached to the body of the figure panel 62 and the curve of the spring 112 extends outwardly from the upper surface 108 as shown. As shown in FIG. 2, when the figure panel 62 is inserted into one of the tracks 18 of the attraction board 10, the U-shaped spring 112 will be compressed into the slot 110. The spring 112 will then exert a force against the upper inner surface 60 and urge the figure panel 62 downwardly to retain it in the track and thereby resist blow out during high winds.

Figure 8:
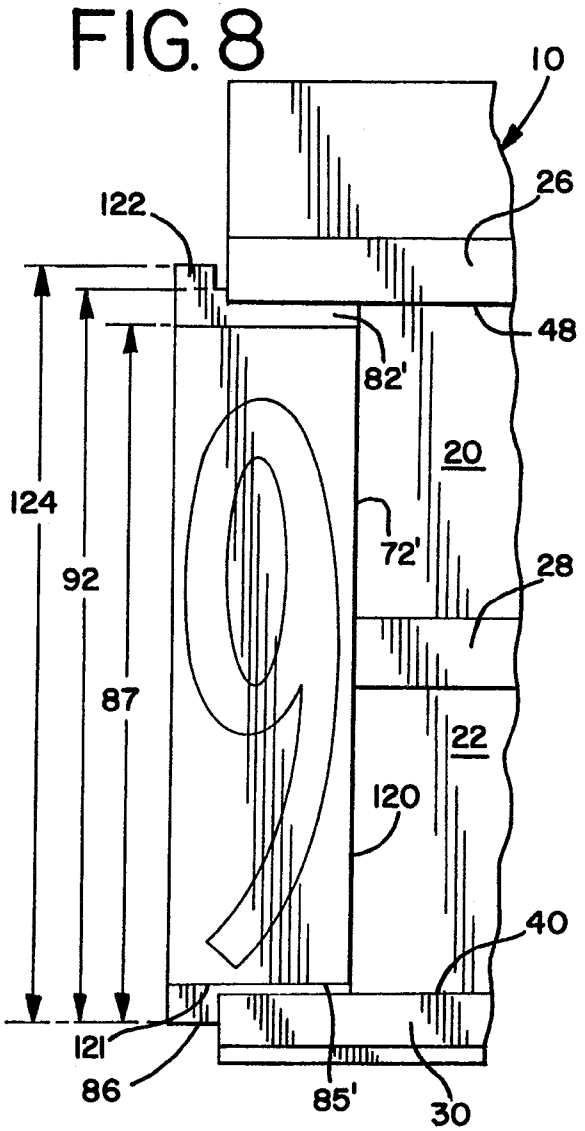
FIG. 8 is a front elevational view of another embodiment of the invention.

An alternate embodiment for retaining a figure panel within a track is shown in FIG. 8. The figure panel 120 in FIG. 8 is substantially similar to figure panel 70 previously described, and elements of figure panel 120 which are like elements of figure panel 70 bear like indicia numbers except that they are primed. The figure panel 120 differs from panel 70 in that the lower edge 121 of the body 72' is co-planar with the offset 85' so as to form a shoulder similar to the upper shoulder 83 of panel 70.

The figure panel 120 has, in additional to all the elements of figure panel 70, a tab 122 at the left end of the upper flange 82'. The tab 122 extends beyond the distal end of the upper flange 82' such that the distance 124 between the lower edge of the lower flange 86' and the distal end of the tab 122 is nearly as large as the distance 126 between the upper inner surface of track 20 and the lower inner surface 58 of track 22.

The figure panel 120 is installed on the attraction board 10 in the same fashion as the figure panel 70 is installed on the attraction board 10 except that the figure panel 120 is installed with the portion of the panel 120 having the tab 122 extending outwardly of the far left end of the attraction board as shown in FIG. 8. The portion of the upper flange 82' having the tab 122 is, therefore, not fitted under the downwardly extending upper lip 48 during the installation of the figure panel 120 on the attraction board 10. When the upper end of flange 82 is fitted under the downwardly extending lip 48, only the right portion of the flanges 82', 86' which are separated by distance 92 are fitted under the upper and lower lips of the board 10. The figure panel 120 is then slid to the right such that the tab 122 will also slide underneath the downwardly extending lip 48. The figure panel 120 will be retained within the channels 20, 22 and will not blow out from high winds because the tab 122 will prevent the figure panel 120 from moving upwardly and prevent the second and third flanges from slipping over the upper edge of the upwardly extending lower lips.

Figure 9:
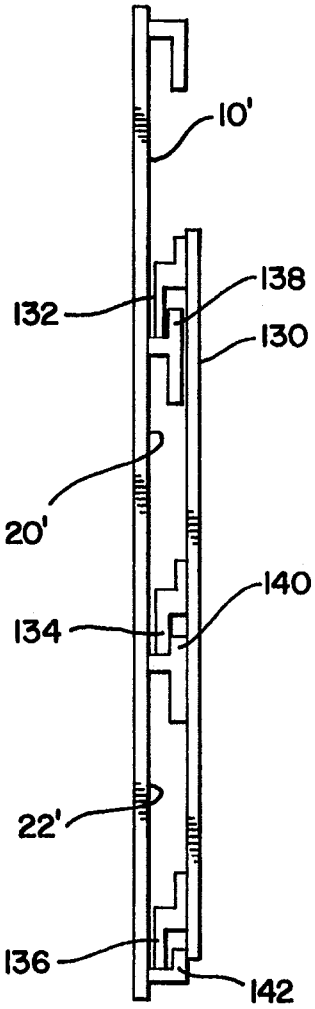
FIG. 9 is a side elevational view of another embodiment of the invention.

Another embodiment of the present invention is depicted in FIG. 9. In this embodiment, an enlarged figure panel 130 is adapted to extend across two tracks 20' and 22' and is retained by three spaced coplanar flanges 132, 134, 136, each of which is adapted to fit under an upwardly ending lip 138, 140, 142, respectively, for retaining the panel 130 to the attraction board 10'. In this embodiment, the weight of the figure panel 130 retains the figure panel 130 to the attraction board 10' and, therefore, blow out of the figure panel 130 could occur.

There is, therefore, disclosed a new and improved figure panel which can be attached to the tracks of an attraction board which have a given size and yet can display an enlarged figure. Furthermore, there is disclosed a figure panel which will be retained within the tracks of an attraction board and not be subject to blow out by high winds or the like.

While the present invention has been described in various specific embodiments, it will be appreciated by those skilled in the art that many changes may be made without departing from the true spirit and scope of the present invention. Therefore, it is the intention of the appended claims to cover all such changes and modifications which come within the true spirit and scope of this invention.

What is claimed:

1. A figure panel for an attraction board having a plurality of parallel spaced horizontal tracks, each track having an upper inner surface and a parallel lower inner surface, a downwardly extending upper lip and an upwardly extending lower lip, said upwardly extending lower lip extending upwardly a first distance and said downwardly extending upper lip extending downwardly a second distance, said second distance being greater than said first distance, said figure panel comprising:

a panel having a central portion, first and second opposing peripheral edges, and an inner surface, a first flange adjacent said first peripheral edge and extending outwardly of said center portion, said first flange offset from said inner surface, a second flange adjacent said second peripheral edge and extending outward of said center portion, said second flange offset from said inner surface, said first flange spaced from said second flange a distance to retain said first flange under one of said downwardly extending upper lips of a first track and said second flange will be retained under one of said upwardly extending lower lip of a second track to thereby retain said figure panel on said attraction board and a third flange offset from said inner surface and positioned between said first and said second flanges.

2. A figure panel for an attraction board having a plurality of parallel equally spaced horizontal tracks, each track having an upper inner surface and a parallel lower inner surface, a downwardly extending upper lip and an upwardly extending lower lip, said upwardly extending lower lip extending upwardly a first distance and said downwardly extending upper extending downwardly a second distance, said figure panel comprising:

a planar body having an upper end adapted to fit under one of said downwardly extending upper lips, and spring means attached to said upper end for exerting a force against said upper inner surface of said track.

3. A figure panel in accordance with claim 2 further comprising:

a first offset flange adapted to fit under one of said downwardly extending upper lips wherein said upper end is an upper end of said first offset flange, and a second offset flange adapted to fit under one of said upwardly extending lower lips.

4. A figure panel for an attraction board having a plurality of parallel equally spaced horizontal tracks, each track having an upper inner surface and a parallel lower inner surface, a downwardly extending upper lip and an upwardly extending lower lip, said upwardly extending lower lip extending upwardly a first distance and said downwardly extending upper extending downwardly a second distance, said second distance being greater than said first distance, said figure panel comprising:

a body having an upper end adapted to fit under one of said downwardly extending upper lips, and said upper end having a side, and a tab on said side of said upper end.

5. A figure panel in accordance with claim 4 wherein said body further comprises:

a first offset flange adapted to fit under one of said downwardly extending upper lips and said upper end is an upper end of said first offset flange, and a second offset flange adapted to fit under one of said upwardly extending lower lips.

6. A figure panel for an attraction board having a plurality of parallel spaced horizontal tracks, each track having an upper inner surface and a parallel lower inner surface, a downwardly extending upper lip and an upwardly extending lower lip, said upwardly extending lower lip extending upwardly a first distance and said downwardly extending upper extending downwardly a second distance, said second distance being greater than said first distance, said figure panel comprising:

a panel having a body, a plurality of downwardly extending co-planar flanges attached to said body, and each of said downwardly extending flanges spaced from an adjacent flange a distance equal to the spacing between said upwardly extending lower lips of said attraction board.

7. A figure panel for an attraction board having a back and a plurality of parallel vertically spaced rails defining a plurality of tracks, including an upper track having an upper inner surface and a downwardly extending upper lip and a lower track having a lower inner surface and an upwardly extending lower lip, at least one of said rails positioned between said upper track and said lower track, said rails extending forward of said back a first given distance, said upper inner surface of said upper track spaced a second given distance from said lower inner surface of said lower track, and said upwardly extending lower lip extending upwardly a third given distance, said downwardly extending upper lip extending downwardly a fourth given distance, said fourth given distance being greater than said third given distance, said figure panel comprising:

a rigid panel having a central portion, upper and lower edges and an inner surface, an upper flange extending outwardly of said central portion, said upper flange inwardly offset from said inner surface a distance not less than said first given distance, a lower flange extending outwardly of said central portion, said lower flange inwardly offset from said inner surface a distance not substantially less than said first given distance, and an upper end of said upper flange spaced from a lower end of said lower flange a distance which is less than the difference between said second given distance and said third given distance and greater than the difference between said second given distance and said fourth given distance.

8. A figure panel for an attraction board having a back and a plurality of parallel spaced horizontal tracks on said back, each track defined by an upper and a lower rail, each of said upper rails having an upper inner surface and a downwardly extending upper lip, and each of said lower rails having a lower inner surface and an upwardly extending lower lip, said upper inner surface of each track spaced a first given distance from said lower inner surface thereof, said upwardly extending lower lip of each track extending upwardly a second given distance, and each of said rails extending forward of said back a third given distance, said figure panel comprising:

a panel having a central portion, first and second opposing peripheral edges, and an inner surface, a first flange adjacent said first peripheral edge and extending outwardly of said center portion, said first flange inwardly offset from said inner surface a distance not less than said third given distance, a second flange adjacent said second peripheral edge and extending outward of said center position, said second flange inwardly offset from said inner surface a distance not less than said third given distance, an upper end of said first flange spaced from a lower end of said second flange a distance a less than the difference between said first given distance and said second given distance, and said first and second peripheral edges separated from each other by a distance greater than said first given distance.

* * * * *

UNITED STATES PATENT AND TRADEMARK OFFICE

CERTIFICATE OF CORRECTION

PATENT NO. : 5,357,701

DATED : October 25, 1994

INVENTOR(S) : Anton Grate

It is certified that error appears in the above—identified patent and that said Letters Patent is hereby corrected as shown below:

In column 7, line 9, after "upper" insert -- lip --.

In column 8, line 57, after "distance" delete "a".

Signed and Sealed this

Seventh Day of February, 1995

*Attest:*

Bruce Lehman

BRUCE LEHMAN

*Attesting Officer*

*Commissioner of Patents and Trademarks*